US007462140B1

(12) United States Patent
Lombardozzi

(10) Patent No.: US 7,462,140 B1
(45) Date of Patent: Dec. 9, 2008

(54) METHOD AND APPARATUS FOR KINESTHETIC BODY CONDITIONING

(76) Inventor: John L. Lombardozzi, 3604 State St., Erie, PA (US) 16508

( * ) Notice: Subject to any disclaimer, the term of this patent is extended or adjusted under 35 U.S.C. 154(b) by 0 days.

(21) Appl. No.: 11/899,641

(22) Filed: Sep. 6, 2007

Related U.S. Application Data

(60) Provisional application No. 60/903,159, filed on Feb. 23, 2007.

(51) Int. Cl.
*A63B 5/20* (2006.01)

(52) U.S. Cl. ..... 482/82; 482/74; 482/108; 482/109; 482/110; 601/15

(58) Field of Classification Search ..... 482/82, 482/74, 108–110; 601/15
See application file for complete search history.

(56) References Cited

U.S. PATENT DOCUMENTS

| | | | | | |
|---|---|---|---|---|---|
| 281,097 | A | * | 7/1883 | McGinnis | 607/77 |
| 310,733 | A | * | 1/1885 | Shaw | 607/77 |
| 593,056 | A | * | 11/1897 | Maingot | 482/108 |
| 768,581 | A | * | 8/1904 | Bulis et al. | 607/77 |
| 3,428,325 | A | * | 2/1969 | Atkinson | 473/256 |
| 3,731,384 | A | * | 5/1973 | Brooks et al. | 433/32 |
| 4,092,799 | A | * | 6/1978 | Anderson | 446/247 |
| 4,093,211 | A | * | 6/1978 | Hughes et al. | 482/49 |
| 4,714,245 | A | * | 12/1987 | Cho | 482/82 |
| 4,801,137 | A | * | 1/1989 | Douglass | 482/82 |
| 4,878,673 | A | * | 11/1989 | Pollard | 473/409 |
| 5,058,883 | A | * | 10/1991 | Dybvik | 482/82 |
| 5,092,583 | A | * | 3/1992 | Rudolf | 482/82 |
| 5,167,596 | A | * | 12/1992 | Ferber | 482/46 |
| 5,180,352 | A | * | 1/1993 | Sreter | 482/108 |
| 5,221,088 | A | * | 6/1993 | McTeigue et al. | 473/201 |
| 5,224,910 | A | * | 7/1993 | Deutsch | 482/82 |
| 5,242,349 | A | * | 9/1993 | Reiff et al. | 482/106 |
| 5,342,271 | A | * | 8/1994 | Long | 482/98 |
| 5,406,300 | A | * | 4/1995 | Tokimoto et al. | 345/31 |
| 5,445,581 | A | * | 8/1995 | Ferber | 482/46 |
| 5,474,293 | A | * | 12/1995 | Tanaka | 473/570 |
| 5,490,817 | A | * | 2/1996 | Stander et al. | 482/46 |
| 5,542,672 | A | * | 8/1996 | Meredith | 463/37 |
| 5,730,655 | A | * | 3/1998 | Meredith | 463/37 |

(Continued)

*Primary Examiner*—Fenn C Mathew
*Assistant Examiner*—Robert F Long
(74) *Attorney, Agent, or Firm*—Richard K Thomson

(57) ABSTRACT

A kinesthetic Chi rope employs a pair of handles, each handle formed as a cylindrical rod with a resonating chamber attached to one end, the chamber having a first coil spring secured as by welding to the internal surface of the chamber and a ball bearing surrounded by the coils which causes an audible vibration when the handle is shaken. A magnet having cylindrical polarity is housed within the cylindrical rod and a second coil spring is compressed between the outer surface of the resonating chamber and the cylindrical magnet, serving as a conductor of the vibratory forces. When the vibration issues from the resonating chamber, the vibrations pulsate through the magnet, into the handle and the hands of the user causing a tactile stimulation to flow into the user's hand, arm and upper torso, an auditory signal to be received from such vibration, a visual stimulus received, and a sinew tension produced by the predetermined weight of the handle, all four inputs combining to provide a kinesthetic input into the user's body restoring homeostasis and balancing to his/her nervous system through her/his acupuncture meridians. A regimen of 12 exercises using the chi handle and rope are taught for stimulating all body parts.

20 Claims, 3 Drawing Sheets

U.S. PATENT DOCUMENTS 5,842,956 A * 12/1998 Strachan ..... 482/82
5,895,341 A * 4/1999 Jones ..... 482/81
5,984,796 A * 11/1999 Mah ..... 473/215
D418,557 S * 1/2000 Cousins ..... D21/672
6,265,984 B1 * 7/2001 Molinaroli ..... 340/815.4
6,286,396 B1 * 9/2001 Johnson ..... 81/60
6,522,255 B1 * 2/2003 Hsieh ..... 340/657
6,540,649 B1 * 4/2003 Niedrich ..... 482/82
6,659,920 B1 * 12/2003 Kurz ..... 482/121
6,752,746 B1 * 6/2004 Winkler et al. ..... 482/82
6,778,866 B1 * 8/2004 Bettwy ..... 700/56
6,887,188 B1 * 5/2005 Davies ..... 482/82
6,932,747 B2 * 8/2005 Herman ..... 482/126
6,969,257 B2 * 11/2005 Groen ..... 434/252
7,147,580 B2 * 12/2006 Nutter et al. ..... 473/457
7,232,238 B2 * 6/2007 Long et al. ..... 362/192
7,329,212 B2 * 2/2008 Roque ..... 482/110
7,337,933 B1 * 3/2008 Klinberg ..... 223/118
D566,206 S * 4/2008 Yang ..... D21/672
7,354,383 B2 * 4/2008 Bardha ..... 482/82
7,361,074 B1 * 4/2008 Periman et al. ..... 446/242
7,404,651 B2 * 7/2008 Long et al. ..... 362/192
2007/0201223 A1 * 8/2007 Long et al. ..... 362/157
2007/0281838 A1 * 12/2007 O'Shea et al. ..... 482/82

* cited by examiner

METHOD AND APPARATUS FOR KINESTHETIC BODY CONDITIONING

This application claims the benefit of provisional application ser. No. 60/903,159 filed Feb. 23, 2007.

BACKGROUND AND SUMMARY OF THE INVENTION

The present invention is directed to the field of alternative medicine. More particularly, the present invention is directed to the use of specially devised handles, with or without an interconnected jump rope, which can deliver multi-dimensional stimulation to a user's meridian system having origin points in the upper extremities or hands resulting in a kinesthetic input into her/his central nervous system which serves to restore homeostasis and balance(chi).

When the human body is healthy, there is a systematic rhythm to a patient's gait, namely, the opposing arm swings naturally forward when a step is taken by either the right or left foot. This involuntary movement is controlled by an autonomic nervous system with the entire body operating as a unified muscle mass in a tension-relaxation cycle. This cycle is controlled by nerve impulses without the need for conscious thought (i.e., it is involuntarily).

In examining dozens of patients, it was determined that this normal gait is interrupted by stress; this stress may result from a traumatic injury, sprain, or strain, or simply as a result of degradation due to the aging process. This stress on the autonomic nervous system causes the body to develop involuntary movement patterns during walking, resulting in an asynchronous gait. This, in turn, produced abnormal torquing of one side of the body vis a vis the opposing side. Thus, what was normally an effortless involuntary function, has become a labor-intensive, exhausting effort involving disruption of the normal operation of the muscular skeletal system that has far-reaching consequences to the individual, producing greatly accelerated wear and tear on the human body. The poor posture, which results from involuntarily compensating for the associated pain, is manifested in unequal muscle length and tensile strength throughout the muscular skeletal system by altering the tension-relaxation cycle. The multiple compensations the patient substitutes for her/his normal rhythmic gait resulting in this abnormal torquing, adversely affectsjoints as well as spinal flexibility, both having negative impact on overall health and well-being.

It is an object of this invention to provide a method and apparatus for providing kinesthetic input comprised of an auditory stimulation, a rhythmic visual excitation, sinew tension produced by 1.5 lbs weights, and a tactile stimulus into the upper extremities and the central nervous system through the acupuncture meridians in the hands, which serves to correct neurological imbalances restoring holistic homeostasis and providing proper balancing of the acupuncture meridians (chi).

The device itself comprises first and second handles which each weigh 1.5 lbs, each handle including a) a cylindrical housing; b) a first cap to close a first upper end thereof, the first cap including a generally spherical resonating chamber; c) a second cap to close a second lower end thereof; d) a first coil spring fixed within the resonating chamber; e) a ball bearing seated with the first coil spring, the ball bearing oscillating within the first coil spring to produce an audible vibration when shaken by a user; f) an elongated, hollow cylindrical magnet having cylindrical polarity, the hollow cylindrical magnet being anchored within the cylindrical housing g) a second coil spring positioned within the cylindrical housing between the resonating chamber and the hollow cylindrical magnet, the second coil spring having a conical configuration with a first large end in physical contact with an external portion of the resonating chamber and a second small end in physical contact with an internal surface of the cylindrical magnet, the second coil spring serving to transmit the auditory vibration into/through said cylindrical magnet; whereby when the first and second handles are retained in a user's hands and shaken to induce the ball bearing to oscillate within the resonation chamber, a tactile stimulation is induced to flow into the user's hands, arms and upper torso, an auditory signal is received from such oscillation, and a visual stimulus received, and a sinew tension produced by the 1.5 lb handles, all four inputs combining to provide a kinesthetic input into the user's body restoring homeostasis and balancing to his/her nervous system through her/his acupuncture meridians.

The beneficial use of this device can be obtained by using the chi rope as a jump rope or simply by using the two handles in accordance with a prescribed regimen of exercises to induce the desired result. These exercises involve shaking the handles in multi-dimensional planes to produce the vibration of the ball bearing within the resonating chamber.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
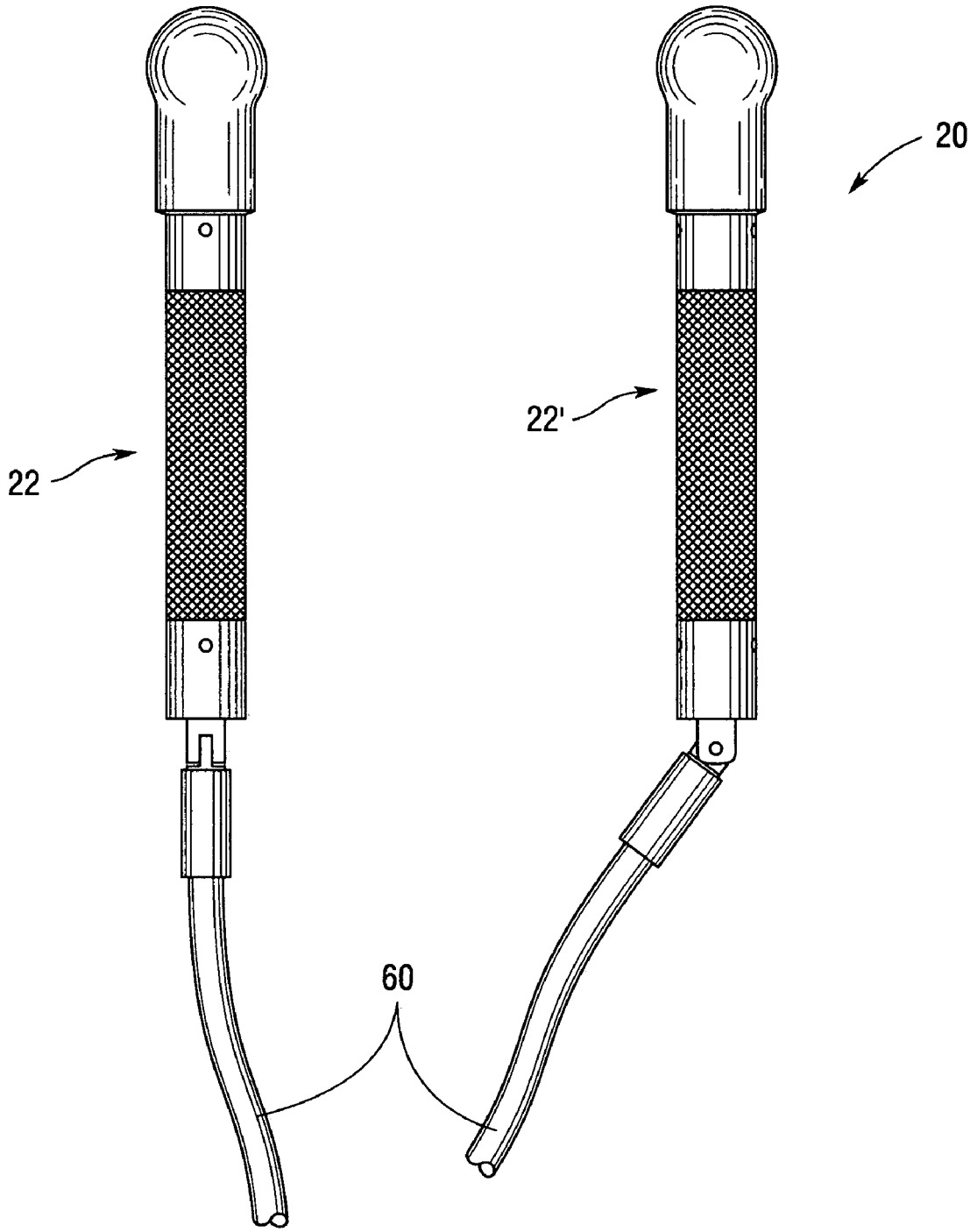
FIG. 1 is a perspective front view of a first embodiment of the of the apparatus of the present invention.

A first embodiment of the Chi rope of the present invention is shown in FIG. 1 generally at 20. Chi rope 20 is comprised of a pair of handles 22, 22' interconnected by a jump rope 60. It will be understood that the principles of the invention can be implemented without the use of jump rope 60 and, in fact, that jump rope 60 is merely one of many ways to obtain the benefits associated with the present invention. If jump rope 60 is utilized, it is preferred that rope 60 be woven of a plurality of leather strands. Constructed in this manner, jump rope 60 is strong, durable, and has a significant degree of stretchability.

Figure 2:
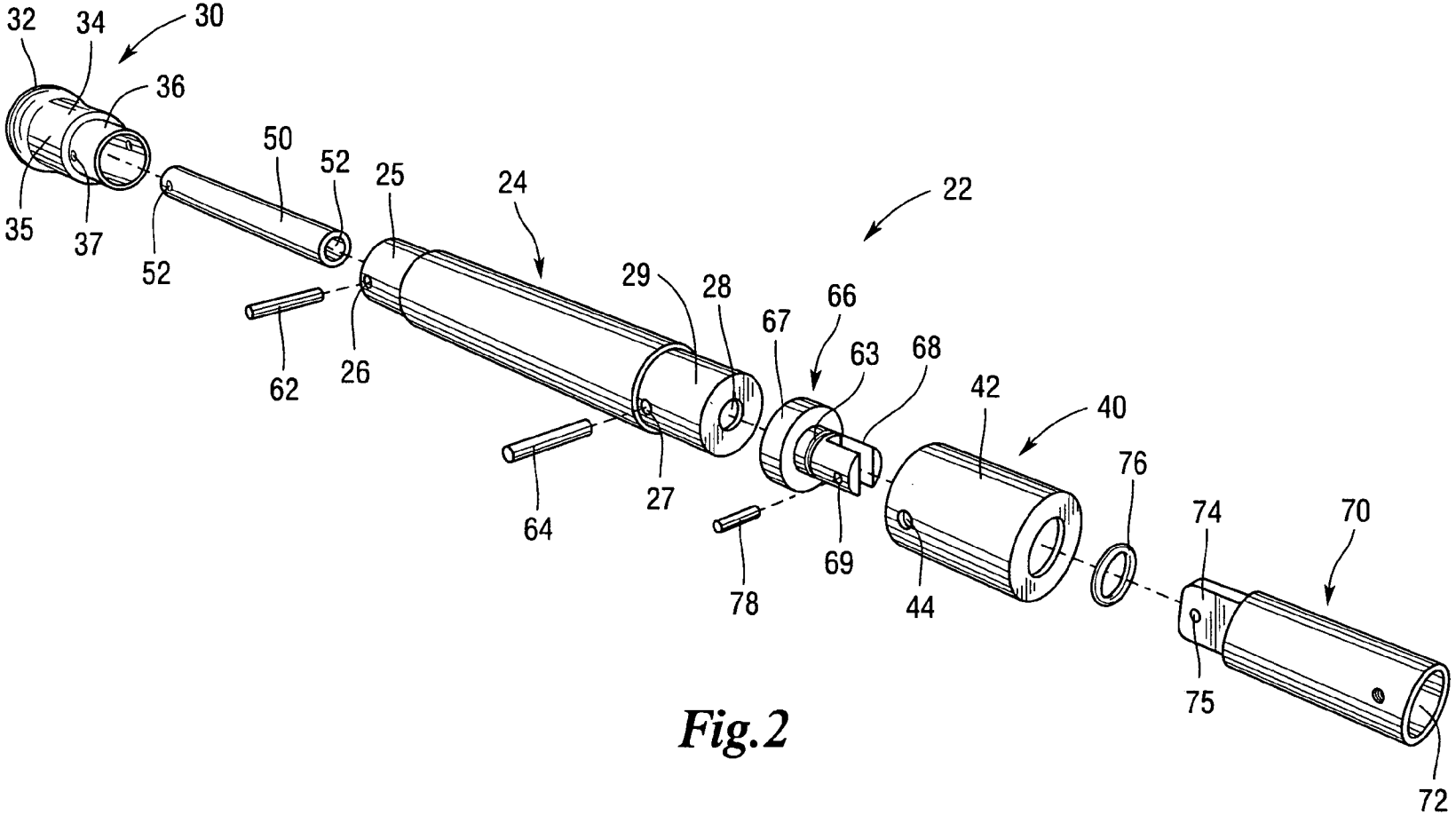
FIG. 2 is an exploded perspective view of one of the handles of the first embodiment.
Figure 3:
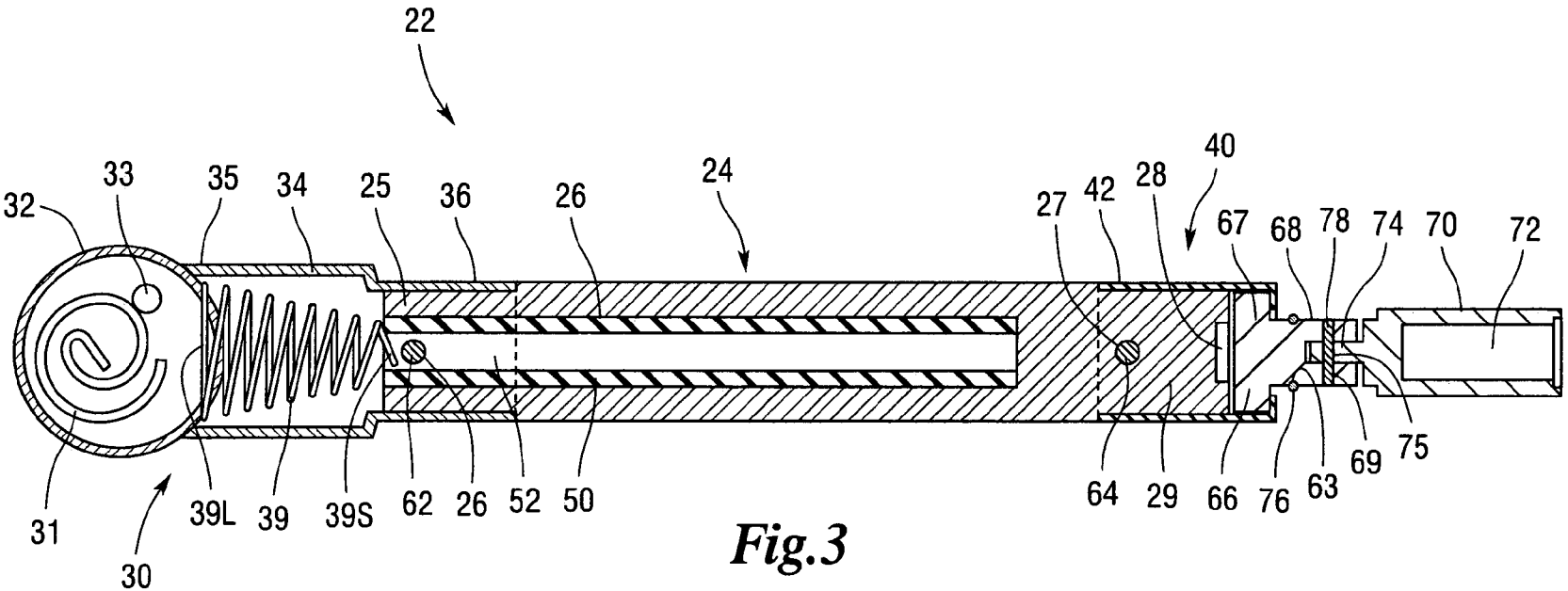
FIG. 3 is a cross-sectional side view of one of the handles of the first embodiment.

Handles 22, 22' are identical and hence, only a single handle 22 will be described. As best seen in FIGS. 2 and 3, handle 22 comprises a generally cylindrical rod 24 having a cylindrical bore 26 extending a significant distance into a first end 25 of rod 24. The external circumference of first end 25 and second end 29 are pared down slightly to accommodate the cylindrical walls 36, 42 of first end cap 30 and second end cap 40, respectively, with the external surfaces of rod 24, cylindrical wall 36 and cylindrical wall 42 having a knurled outer periphery of handle 22.

First end cap 30 has two principal parts: hollow sphere 32 and step-down cylindrical member 34. By way of example and not limitation, hollow sphere is made of lead and step-down cylindrical member 34 is made of copper. The exteriors of both are preferably powder coated with a flat black finish for an aesthetically pleasing appearance. Internally, hollow sphere 32 has fixed by welding or the like, a coil spring 31 which captures a spherical ball bearing 33 within its coils. First larger diameter cylindrical wall 35 is secured to hollow sphere 32 as by welding. A second helical coil spring 39 is positioned inside cylindrical wall 35 with its large diameter end 39L pressed firmly against the exterior of sphere 32 while its small diameter end 39S extends into an interior region 52 of cylindrical magnet 50. Cylindrical magnet 50 is hollow in order to produce a cylindrical magnetic field which radiates outwardly through the cylindrical rod 24 into the hands of the user. Pin 62 passes through openings 26 in cylindrical rod 24, 52 in cylindrical magnet 50, and 37 in cylindrical wall 36 of first end cap 30 to keep cap 30 secured to rod 24. Similarly, pin 64 passes through hole 44 in wall 42 of end cap 40 and hole 27 in cylindrical rod 24 to secure second end cap 40 to rod 24.

Within second end cap 40 is positioned bearing swivel pin 66 having a clevis end 68. Recess 28 is formed in the lower end 29 of cylindrical rod 24 to reduce the surface area of end 29 in contact with the head 67 of swivel pin 66 to enhance rotation thereof. Coupling 70 has a hollow end 72 which receives an end of rope 60 and a protruding finger 74 which is machined flat to fit between arms of clevis end 68. Retaining pin 78 is received through hole 75 in protruding finger 74 and aligned holes 69 in arms of clevis end 68 to pivotally secure coupling 70 to swivel pin 66. O-ring 76 is received in groove 63 on clevis end 68.

A regimen of twelve different exercises are prescribed for using the chi handles 22, 22' of the present invention. As background, it should be noted that Eastern philosophy attributes most illness to internal weakness and believes that if the weakness is eliminated through exercise, there will be no room for disease. Modern scientific technology (Western thought) associates most diseases with infectious bacteria or other agents external to the body and, accordingly, attempts to eliminate these external factors through the use of drugs which modifies the environment inhabited by the virus. The Kinesthetic Enhancement Method of Conditioning taught by the present invention is designed to stimulate every vital area of the body (i.e., to strengthen potential areas of weakness). The key to successful implementation of the Method lies in the fact that each exercise deals with specific organs, nerves and muscles through a scientific combination of body movements using the chi handles 22, 22' along with breath control. Therefore, it will be appreciated for optimum benefit each of the enumerated exercises should be performed in the order set forth and all of the twelve should be incorporated into the regimen to achieve the cumulative effects.

With regard to when to perform the exercises, it will be appreciated that by performing these exercises on an empty stomach, food digestion will not compete for blood flow with the body portions being strengthened. Accordingly, the four optimum times for exercising are before breakfast, lunch, dinner and bedtime. It is most beneficial that whatever routine be established, that it be adhered to with decided regularity. It is preferred that the exercises be performed each day, although those who have not made regular exercise part of their daily regimen should work up to a daily routine gradually. A possible proposed schedule would be twice a week for the first month; every other day for the next six weeks; begin every day exercises at your own discretion as you feel sufficiently energetic. It daily exercise saps too much energy, return to every other day until you have built sufficient strength to embrace a daily regimen. During initial implementation, the days off are part of the "body building" as the muscles regenerate at the cellular level.

Prior to initiating the exercise regimen, employ alternate nostril breathing to balance left and right sides of the brain. Collapse your right nostril and breathe through your left nostril only for a count of three; be sure not to inhale/exhale through your mouth or you will not benefit from this pre-exercise step. Repeat for the right nostril for a three count. Then, inhale deeply through both nostrils and exhale through your mouth. You are now ready to initiate the regimen.

The first exercise, Loosening the Sinews, is designed to ensure that the skeletal musculature is properly relaxed thereby alleviating surface tension. Grasping one handle 22, 22' in each hand, stand erect with feet shoulder width apart. Relax the hands and arms allowing them to hang loosely by your sides. This is defined as the starting position for all exercises in this regimen. Simultaneously shake handles, 22, 22'. Lift your right leg, gently shaking the handles with a gentle flipping of your lower right leg from the knee down. Repeat on the opposite side. Consciously attempt to relax your neck muscles allowing your head to drop forward as far as possible. Slowly revolve your head clockwise for two revolutions and then counterclockwise for two revolutions. Standing erect, extend your arms directly out from your shoulders with your palms downwardly. Now extend your arms straight above your head stretching upwardly on the balls of your feet reaching as high as you can. Shake chi handles 22, 22' for a five count, then allow your arms to return to your sides and your heels to the floor. Stand completely still for a five count as your muscles relax. Repeat the Loosening the Sinews exercise twice each session before proceeding.

The second exercise, The Daily Dance, is a gait correction exercise bringing the body into a natural rhythm of fluid movement by resetting the autonomic and sympathetic nervous systems. While standing at the starting position, breathe through your nose while shaking chi handles 22, 22' throughout the inhale/exhale cycle. Next, inhale while stepping forward with your left foot swinging your right arm forward straight in front of you to shoulder height. Shake chi handle 22 for a two count; then exhale and return to starting position. Shake the chi handles 22, 22' twice while at your sides. Repeat for the opposite side. Do each side three times.

Sitting On Air, the third exercise, stretches the sinews resolving deeper bodily tension. While at the starting position, bend your knees to a height generally equal to sitting on a chair with heels on the ground. Inhale and extend handles 22, 22' in front of you parallel to your shoulders, shaking twice. Lift handles 22, 22' directly overhead fully extended; shake twice. Bending your elbows, return handles to shoulder height. Repeat sequence 3-5 times. Stand erect with handles 22, 22' at your side and shake each leg successively. Stand quietly for 1 minute.

The fourth exercise, Climbing Cliffs, is a stretching movement designed to expand the chest cavity and all internal organs stimulating the digestive tract including the blood cleansing organs: the liver and the kidneys. From the starting position, while inhaling, bend the right knee parallel to the ground forming a 90° while simultaneously extending the left-handed chi handle to full extension directly overhead. Shake handles twice; while exhaling, lower left arm and right leg. Repeat with opposite arm/leg combination. Return to starting position; shake handles twice. Gradually increase reps of this exercise from 4 the first month, to 5 the second month, and 6 the third and subsequent months. This is identified as the first progressive cycle.

The fifth exercise, Rising Sun and Sleeping Moon, is specifically designed to stimulate the kidneys with additional benefits to the spleen and stomach. From the starting position, inhale and lift both arms directly overhead keeping elbows straight. Lift heels off the ground; shake the handles 22, 22' twice. Lower your arms and squat as deeply as you can with arms extended toward the front toward the ground. Shake the chi handles 22,22' twice. Repetitions should be increased from 3 times the first month, to four times the second month, to five times the third and subsequent months. As a beginner, you will experience discernable energy sensations at this point in the regimen with each subsequent exercise. This is the second progressive cycle.

The sixth exercise, Babbling Brook, is designed to stimulate the entire polarity of the meridian system pathways with particular emphasis on spinal column opening up the sacrum area to increase both cerebral spinal fluid flow and elasticity of the spine. From the starting position, inhale deeply; as you are exhaling, squat as deeply as you can resting your elbows on your knees with your arms fully extend toward the ground in front of you. Gently bounce on the balls of your feet while shaking the chi handles 22, 22'. Hold for 1-3 minutes, depending on your individual comfort level. Inhale as you slowly stand erect resuming the starting position. Continue breathing while shaking handles for a count of two cycles. Increase reps in accordance with the first progressive cycle.

Lifting Stones, the seventh exercise in the series, manipulates the lower spinal region which contains all major nerves leading to the brain thereby toning the entire nervous system. Cracking of the back may be heard; this is a beneficial sign of progress. From the starting position, lift the chi handles overhead with palms inward as you inhale. Continue inhaling, as you bend backwards as far as possible, until your lung capacity is reached. Then, slowly lean forward as far as you are able reaching the chi handles between your legs. Give the handles two shakes. Repeat three times. Increase the reps in accordance with the second progressive cycle.

The eighth exercise in the series, Throwing Spear, is designed to stretch primarily the spine. Stimulating the entire length of the spine has a positive impact on mood and memory as well as treating back aches, neck aches, depression and nervousness. From the starting position, take a big step forward with the right foot as you inhale while swinging your left arm forward to an angle 45° above horizontal while shifting your weight to your front foot in a lunge position. Hold the lunge position, as well as your breath, while shaking both handles twice. Exhale and slowly reverse the motion returning to starting position. Shake handles twice. Repeat on the opposite side. Use the second progressive repetition cycle.

The Balance for Life, or ninth exercise, is designed to move the Chi (life force) from below the naval upwardly into the chest and arms. From the starting position, inhale and shake the chi handles twice. Taking a deep breath, lift the right leg to a 90° bend. Lean your body forward reaching outwardly in front of you with both arms while extending your right leg behind you for balance until your body forms a straight line which is orthogonal to your left leg. Shake the chi handles twice. Slowly exhale and begin to reverse the movement to the starting position; shake the handles twice. Repeat for the opposite leg. Use the second progressive repetition cycle for this exercise.

The tenth exercise, Trees Shading Leaves, is performed by shaking the chi handles twice in the starting position. Inhale deeply as you raise your arms from your sides to a position crossed above your head, shaking throughout the movement. Reverse the movement while exhaling until your arms are at your sides. Repeat four times.

Growing Roots in Silence, the eleventh exercise, is performed from the starting position. Chi handles 22, 22' are shaken 25 times simultaneously. Stand in silence for two minutes while breathing deeply, slowly, ensuring that you extend your diaphragm fully with each inhalation and fully collapsing with each exhalation.

The twelfth exercise, Jumping to Health, involves the use of the chi handles 22, 22', with the jump rope. Use alternating nostril breathing before initiating to fire both sides of the brain. The use of a mat is recommended to reduce shock to the body, particularly the joints. From the starting position, position the rope in front of your feet. Shake the handles twice. Jump rope in a conventional manner as many reps as possible. Each time a misstep is encountered, breathe for a full cycle and shake the handles twice to re-initialize, before starting again. Continue until you achieve 25 reps without a hitch.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. An exercise device comprising:

first and second handles each handle having a predetermined weight and including a) a cylindrical rod having a cylindrical bore therein creating a housing;

b) a first cap attached to a first upper end of said cylindrical rod closing said housing, said first cap including a generally spherical resonating chamber;

c) a second cap attached to a second lower end of said cylindrical rod;

d) a first coil spring fixed within said resonating chamber;

e) a ball bearing seated within said first coil spring, said ball bearing oscillating within said first coil spring to produce an audible vibration when shaken by a user;

f) an elongated, hollow cylindrical magnet having cylindrical polarity, said hollow cylindrical magnet being anchored within said housing in said cylindrical rod;

g) a second coil spring in said first cap extending between said resonating chamber and said hollow cylindrical magnet, said second coil spring having a conical configuration with a first large end in physical contact with an external portion of said resonating chamber and a second small end in physical contact with an internal surface of said cylindrical magnet, said second coil spring serving to transmit said auditory vibration into/through said cylindrical magnet;

whereby when said first and second handles are retained in a user's hands and shaken to induce said ball bearing to oscillate within said resonation chamber, a tactile stimulation is induced to flow into the user's hands, arms and upper torso, an auditory signal is received from such oscillation, a visual stimulus received, and a sinew tension produced by the predetermined weight of the handles, all four inputs combining to provide a kinesthetic input into the user's body restoring homeostasis and balancing to his/her nervous system through her/his acupuncture meridians.

2. The exercise device of claim 1 further comprising means to interconnect said first and second handles.

3. The exercise device of claim 2 wherein said means to interconnect said first and second handles comprises a braided rope.

4. The exercise device of claim 3 further comprising a swivel bracket connecting said braided rope to each of said first and second handles.

5. The exercise device of claim 1 wherein said second spring is a conical spring with a large end and a small end, said small end being received in a first end of said hollow cylindrical magnet.

6. An exercise device comprising:

at least a first handle having a predetermined weight and including a) a cylindrical rod having a cylindrical bore therein creating a housing;

b) a first cap attached to a first upper end of said cylindrical rod closing said housing, said first cap including a generally spherical resonating chamber;

c) vibration producing means within said resonating chamber for generating an audible vibration signal when said first handle is shaken by a user;

d) a magnet having cylindrical polarity, said magnet being anchored within said housing in said cylindrical rod;

e) conducting means extending between said resonating chamber and said magnet, said conducting means having a first end in physical contact with an external portion of said resonating chamber and a second end in physical contact with a portion of said magnet, said conducting means serving to transmit said auditory vibration through said magnet;

whereby when said at least one handle is retained in a user's hands and shaken to activate said vibration producing means in said resonation chamber, a tactile stimulation is induced to flow into the user's hand, arm and upper torso, an auditory signal is received from such vibration, a visual stimulus received, and a sinew tension produced by the predetermined weight of the handle, all four inputs combining to provide a kinesthetic input into the user's body restoring homeostasis and balancing to his/her nervous system through her/his acupuncture meridians.

7. The exercise device of claim 6 further comprising a second handle of identical configuration to said at least first handle.

8. The exercise device of claim 6 wherein said conducting means comprises a conical spring with a first large end in direct contact with said generally spherical resonating chamber and a second smaller end, a terminus of said smaller end entering a hollow end of said magnet.

9. An exercise performed using the exercise device of claim 7, said exercise comprised of the steps of a) grasping one handle in each hand, stand erect with feet shoulder width apart;

b) relax the hands and arms allowing them to hang loosely by your sides;

c) simultaneously said shake handles;

d) lift your right leg, gently shaking the handles with a gentle flipping of your lower right leg from the knee down;

e) repeat on the opposite side;

f) relax your neck muscles allowing your head to drop forward as far as possible;

g) slowly revolve your head clockwise for two revolutions and then counterclockwise for two revolutions;

h) standing erect, extend your arms directly out from your shoulders with your palms downwardly;

i) now extend your arms straight above your head stretching upwardly on the balls of your feet reaching as high as you can;

j) shake chi handles for a five count, then allow your arms to return to your sides and your heels to the floor;

k) stand completely still for a five count as your muscles relax;

l) repeat twice before proceeding.

10. An exercise performed using the exercise device of claim 7, said exercise comprised of the steps of a) grasping one handle in each hand, stand erect with feet shoulder width apart;

b) relax the hands and arms allowing them to hang loosely by your sides;

c) breathe through your nose while shaking chi handles throughout the inhale/exhale cycle;

d) inhale while stepping forward with your left foot swinging your right arm forward straight in front of you to shoulder height;

e) shake chi handle for a two count;

f) exhale and return to starting position;

g) shake the chi handles twice while at your sides;

h) repeat for the opposite side;

i) perform exercise for each side three times.

11. An exercise performed using the exercise device of claim 7, said exercise comprised of the steps of a) grasping one handle in each hand, stand erect with feet shoulder width apart;

b) relax the hands and arms allowing them to hang loosely by your sides;

c) bend your knees to a height generally equal to sitting on a chair with heels on the ground;

d) inhale and extend handles in front of you parallel to your shoulders, shaking twice;

e) lift handles directly overhead fully extended and shake twice;

f) bending your elbows, return handles to shoulder height;

g) repeat sequence 3-5 times;

h) stand erect with handles at your side and shake each leg successively;

i) stand quietly for 1 minute.

12. An exercise performed using the exercise device of claim 7, said exercise comprised of the steps of a) grasping one handle in each hand, stand erect with feet shoulder width apart;

b) relax the hands and arms allowing them to hang loosely by your sides;

c) while inhaling, bend the right knee parallel to the ground forming a 90° while simultaneously extending the left-handed chi handle to full extension directly overhead;

d) shake handles twice;

e) while exhaling, lower left arm and right leg;

f) repeat with opposite arm/leg combination;

g) return to starting position;

h) shake handles twice.

13. An exercise performed using the exercise device of claim 7, said exercise comprised of the steps of a) grasping one handle in each hand, stand erect with feet shoulder width apart;

b) relax the hands and arms allowing them to hang loosely by your sides;

c) inhale and lift both arms directly overhead keeping elbows straight;

d) lift heels off the ground;

e) shake the handles twice;

f) lower your arms and squat as deeply as you can with arms extended toward the front toward the ground;

g) shake the chi handles twice.

14. An exercise performed using the exercise device of claim 7, said exercise comprised of the steps of a) grasping one handle in each hand, stand erect with feet shoulder width apart;

b) relax the hands and arms allowing them to hang loosely by your sides;

c) inhale deeply;

d) as you are exhaling, squat as deeply as you can resting your elbows on your knees with your arms fully extend toward the ground in front of you;

e) gently bounce on the balls of your feet while shaking the chi handles;
f) hold for 1-3 minutes, depending on your individual comfort level;
g) inhale as you slowly stand erect resuming the position of step b);
h) continue breathing while shaking handles for a count of two cycles.

15. An exercise performed using the exercise device of claim 7, said exercise comprised of the steps of
a) grasping one handle in each hand, stand erect with feet shoulder width apart;
b) relax the hands and arms allowing them to hang loosely by your sides;
c) lift the chi handles overhead with palms inward as you inhale;
d) continue inhaling, as you bend backwards as far as possible, until your lung capacity is reached;
e) then, slowly lean forward as far as you are able reaching the chi handles between your legs;
f) give the handles two shakes;
g) repeat three times.

16. An exercise performed using the exercise device of claim 7, said exercise comprised of the steps of
a) grasping one handle in each hand, stand erect with feet shoulder width apart;
b) relax the hands and arms allowing them to hang loosely by your sides;
c) take a big step forward with the right foot as you inhale while swinging your left arm forward to an angle 45° above horizontal while shifting your weight to your front foot in a lunge position;
d) hold the lunge position, as well as your breath, while shaking both handles twice;
e) exhale and slowly reverse the motion returning to the position of step b);
f) shake handles twice;
g) repeat on the opposite side.

17. An exercise performed using the exercise device of claim 7, said exercise comprised of the steps of
a) grasping one handle in each hand, stand erect with feet shoulder width apart;
b) relax the hands and arms allowing them to hang loosely by your sides;
c) inhale and shake the chi handles twice;
d) taking a deep breath, lifting the right leg to a 90° bend;
e) lean your body forward reaching outwardly in front of you with both arms while extending your right leg behind you for balance until your body forms a straight line which is orthogonal to your left supporting leg;
f) shake the chi handles twice;
g) slowly exhale and begin to reverse the movement to the starting position;
h) shake the handles twice;
i) repeat for the opposite leg.

18. An exercise performed using the exercise device of claim 7, said exercise comprised of the steps of
a) grasping one handle in each hand, stand erect with feet shoulder width apart;
b) relax the hands and arms allowing them to hang loosely by your sides;
c) inhale deeply as you raise your arms from your sides to a position crossed above your head, shaking throughout the movement;
d) reverse the movement while exhaling until your arms are at your sides;
e) repeat four times.

19. An exercise performed using the exercise device of claim 7, said exercise comprised of the steps of
a) grasping one handle in each hand, stand erect with feet shoulder width apart;
b) relax the hands and arms allowing them to hang loosely by your sides;
c) shake chi handles 25 times simultaneously;
d) stand in silence for two minutes while breathing deeply, slowly, ensuring that you extend your diaphragm fully with each inhalation and fully collapsing with each exhalation.

20. An exercise performed using the exercise device of claim 7, said exercise comprised of the steps of
a) attaching a rope to said two handles;
b) use alternating nostril breathing before initiating to fire both sides of the brain;
c) grasping one handle in each hand, stand erect with feet shoulder width apart;
d) relax the hands and arms allowing them to hang loosely by your sides, said rope extending in front of your feet;
e) shake the handles twice;
f) jump rope in a conventional manner as many reps as possible;
g) each time a misstep is encountered, breathe for a full cycle and shake the handles twice to re-initialize, before starting again;
h) continue until you achieve 25 reps without a hitch.

* * * * *